US005467566A

United States Patent [19]

Swartz et al.

[11] Patent Number: 5,467,566

[45] Date of Patent: Nov. 21, 1995

[54] CURTAIN WALL CLIP

[75] Inventors: Allan J. Swartz, Orange; Gregory A. Kulpa, Tustin, both of Calif.

[73] Assignee: Swartz & Kulpa, Structural Design and Engineering, Tustin, Calif.

[21] Appl. No.: 299,320

[22] Filed: Aug. 31, 1994

Related U.S. Application Data

[63] Continuation of Ser. No. 783,854, Oct. 28, 1991, abandoned.

[51] Int. Cl.[6] ..... E04B 5/00

[52] U.S. Cl. ..... 52/235; 52/285.3; 52/715

[58] Field of Search ..... 52/235, 702, 703, 52/715, 285.3, 283, 712, 236.6, 236.7, 236.9, 317; 411/531, 546, 547, 533; 248/247, 248, 250, 300; 403/205, 382, 232.1, 403, 406.1

[56] References Cited

U.S. PATENT DOCUMENTS

| | | | |
|---|---|---|---|
| 723,730 | 3/1903 | Reilly . | |
| 813,253 | 2/1906 | Sullivan | 52/715 X |
| 1,008,118 | 11/1911 | Crilly . | |
| 1,146,251 | 7/1915 | Harp | 52/702 X |
| 1,366,470 | 1/1921 | Lampert . | |
| 1,762,254 | 6/1930 | Zarba . | |
| 1,905,616 | 4/1933 | Zanella . | |
| 1,929,009 | 10/1933 | Williams | 411/531 X |
| 2,321,671 | 6/1943 | Grotta . | |
| 2,588,631 | 3/1952 | James | 248/300 X |
| 3,210,898 | 10/1965 | Kurtz | 52/715 X |
| 3,267,624 | 8/1966 | Wozniak et al. | 52/715 X |
| 3,284,117 | 11/1966 | Meehan . | |
| 3,350,830 | 11/1967 | Smith . | |
| 3,976,307 | 8/1976 | Ogisu | 411/531 X |
| 4,121,391 | 10/1978 | Schroeder . | |
| 4,329,826 | 5/1982 | Flogaus . | |
| 4,557,088 | 12/1985 | Kaminaga . | |
| 4,570,400 | 2/1986 | Slager et al. . | |
| 4,594,017 | 6/1986 | Hills | 52/702 X |
| 4,619,559 | 10/1986 | Norris | 411/531 X |

OTHER PUBLICATIONS

Vertical Movement Clip—Brochure.

*Primary Examiner*—Lanna Mai
*Attorney, Agent, or Firm*—Harold L. Jackson

[57] ABSTRACT

A curtain wall clip for coupling a curtain wall framing structure to the floor structure or load bearing structure of a building is disclosed. The curtain wall clip includes a flat plate portion with two closely spaced oppositely depending ears, each ear having an elongated slot therein. The plate portion of the curtain wall clip is attached to the floor structure. Spacers are inserted into the slots, and the ears and spacers are attached to the curtain wall frame structure by screws. The spacers and screws hold the curtain wall clip is sliding engagement with the frame.

20 Claims, 2 Drawing Sheets

CURTAIN WALL CLIP

This is a file-wrapper-continuation of U.S. Ser. No. 783,854 filed Oct. 28, 1991, now abandoned.

BACKGROUND OF THE INVENTION

1. Field of the Invention

The invention relates generally to building structures and more particularly to a curtain wall slide clip for coupling non-load bearing curtain walls to the load bearing infrastructure of a building.

2. Description of Related Art

Many single story and multiple story buildings are constructed every year. Due to the high cost of labor and materials, every labor saving step or simplification in the construction process can result in marked savings in the cost of a building. Accordingly, efficiency and simplicity are demanded in building construction technology today as in all other technologies to yield an affordable product to the end consumer. A modern building anatomy includes a load bearing structure which supports the floors and roof of a building, and a non-load bearing outer structure, known as curtain walls, which supports the outer facing or walls of a building. More specifically, the load bearing structure comprises a skeletal arrangement of spaced apart horizontal and vertical beams securely attached together. The floor typically is a cement slab which is supported by this load bearing structure. The load bearing structure is designed such that upon loading and unloading of the floor with furniture, cabinets, equipment or other heavy items, the floor may deflect downwardly or upwardly. The non-load bearing structure or curtain wall comprises an exterior wall facing which is supported and backed by another skeletal type beam structure. The curtain wall skeletal framing members are made of relatively light weight materials, such as aluminum, and hence cannot support a heavy load.

The curtain wall must be linked to the load bearing structure and floor to hold the walls in their upright vertical position but without the load bearing structure or floor transferring any weight to the curtain wall during normal deflections of the floor. This is accomplished by curtain wall slide clips. Curtain wall clips while securing the floor structure and the wall structure in alignment also allow the floor to freely slide up or down along the curtain wall framing members such that the floor transfers no vertical pressure on the curtain wall. The walls of the building therefore will not buckle due to deflections of the floor which might cause permanent and expensive damage to the building.

Several types of curtain wall slide clips have evolved over the years in an effort to provide a coupling mechanism for securing curtain walls to a building load bearing structure and floors. One such clip is an L-shaped metal clip having an elongated slot traversely disposed within one of the legs, the other leg being solid (known in the industry as vertical movement clip). The solid leg is welded to a horizontal metal support angle which extends along the edge of a cement floor slab, while the other leg is bolted to a curtain wall framing stud. This curtain wall slide clip, however, is difficult to use on webbed curtain wall studs which have a plurality of holes therein along the length of the stud. In such a case, if the floor slab happens to align with such a hole, the hole typically must be covered with a plate and the curtain wall slide clip attached to the plate. This procedure is both labor intensive and time consuming adding unnecessary steps and expense to a building.

Another curtain wall slide clip structure disclosed in U.S. Pat. No. 4,121,391, Schroeder includes an L-shaped metal clip having a slot therein that extends longitudinally through a first leg and into a second leg. The slot is fit over the lip of a C-shaped curtain wall stud and the first leg is welded to the peripheral edge of a metal support angle along the edge of a cement floor slab. This particular curtain wall slid clip structure is limited to use with C-shaped curtain wall studs. Another disadvantage of this particular slide clip is that the floor slab and curtain wall stud must be substantially adjacently located. If there is a significant space between the floor slab and curtain wall stud, a metal shim may be needed to be affixed therebetween to bring the two structures close enough together to use this slide clip. This extra procedure can be expensive and time consuming.

In U.S. Pat. No. 4,570,400, Slager discloses a square C-shaped slide clip having a slot through the back portion of the clip. The slot is fit over the lip of a C-shaped curtain wall stud and the back of the clip is welded to a peripheral edge of the floor slab metal support angle. As with the above described curtain wall slide clip, the use of this particular clip is limited to C-shaped curtain wall studs and has limited horizontal adjustability which may require the use of shims if the curtain wall stud and floor slab are not substantially aligned.

It would therefore be an advancement in the art to provide a simple slide clip structure that eliminates the aforementioned disadvantages of the prior art.

SUMMARY OF THE INVENTION

It is therefore an object of the invention to provide a curtain wall clip that is simple and inexpensive to manufacture.

It is another object of the invention to provide a curtain wall clip that has good strength but yet is relatively light in weight.

It is still a further object of the invention to provide a curtain wall clip that is easy to handle and install.

It is yet another object of the invention to provide a simple fastening arrangement for slideably securing a curtain wall clip to a curtain wall stud.

It is an advantage of the invention that the curtain wall clip can be installed without the need of special shims or plating as may be required by prior art clip structures.

A curtain wall clip according to the present invention comprises an attachment portion for being securely affixed to the load bearing or floor structure portion of a building. The curtain wall clip further has two oppositely disposed, offset depending ears, each ear having an elongated slot therein. The ears through their elongated slots are slideably fastened to a curtain wall stud of a building wall structure. If any deflection of the floor structure should occur due to loading or unloading thereof, the clip will slide along the curtain wall stud. Any floor deflections therefore will be isolated from the curtain wall structure.

Other and further objects, advantages and characteristic features of the present invention will become readily apparent from the following detailed description of preferred embodiments of the invention when taken in conjunction with the accompanying drawings.

DESCRIPTION OF PREFERRED EMBODIMENTS

Figure 1:
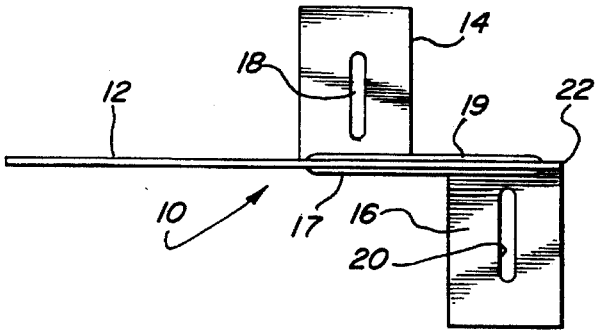
FIG. 1 is a side view of a curtain wall clip in accordance with the invention.
Figure 12:
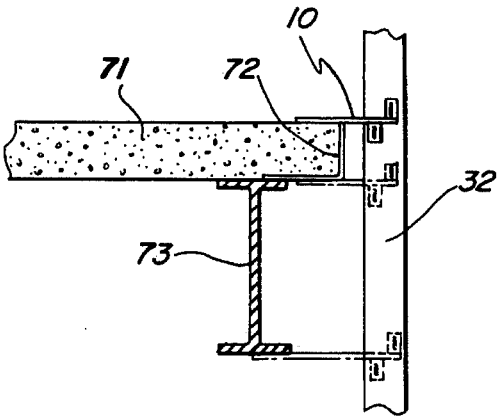
FIG. 12 is a side elevation view of a building floor structure and curtain wall stud coupled together using a curtain wall clip of the present invention.

Referring now with more particularity to the drawings, wherein like or similar parts are designated by the same numerals throughout the various figures, a curtain wall clip 10 in accordance with the principles of the invention is illustrated in FIG. 1 having an flat elongated plate 12. The flat elongated plate 12 provides an attachment portion to which a floor or load bearing structure of a building may be securely fastened (shown and described with more particularity with reference to FIG. 12). Two ears 14, 16 depend from one of the elongated side edges 15 of the flat elongated plate 12, in opposite directions therefrom. The two ears 14, 16 are preferably coplanar with each other and extend in a perpendicular relationship to the plane of the fiat elongated plate 12. Additionally, ears 14, 16 are located near or at one end 22 of fiat elongated plate 12 and depend from elongated side edge 15 in either an adjacent or closely spaced relationship.

The curtain wall clip 10 may be made of any thin metal material which is amendable to welding. The clip may be manufactured by stamping the flat elongated plate 12, ears 14, 16 and elongated slots 18, 20 out of sheet metal. The ears are then bend oppositely into position. Elongated embossments 17, 19 may also be stamped into the flat plate portion 12 to strengthen it thereby allowing thinner gage metal sheets to be used in constructing the curtain wall clip 10.

Figure 2:
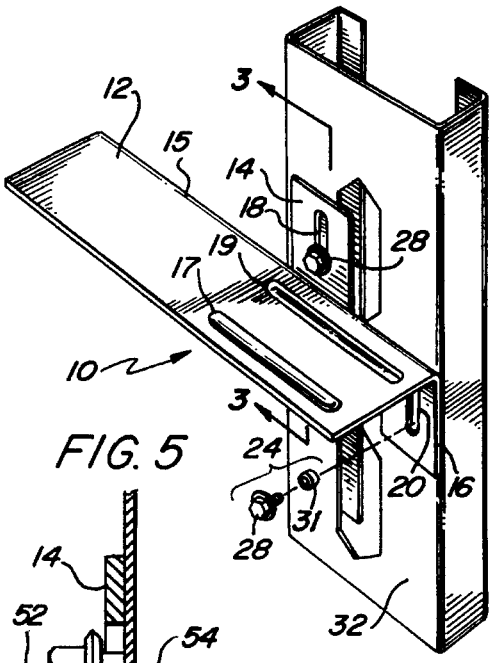
FIG. 2 is a perspective, partially exploded view of the curtain wall clip of FIG. 1 slideably attached to a typical curtain wall framing stud.
Figure 3:
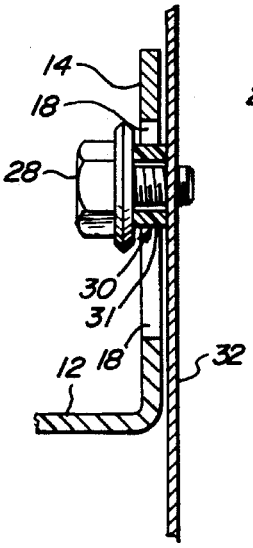
FIG. 3 is a side sectional view of the assembly in cross-section taken along line 3—3 of FIG. 2.

FIGS. 2 and 3 illustrate a fastening arrangement for slideably securing curtain wall clip 10 to a curtain wall stud 32, which includes fastening means 24 comprising threaded member 28 and spacer means 30. Threaded member 28 may be a self-taping threaded screw having a head of larger diameter than the width of elongated slots 18 or 20. Spacer 30 may be a relatively thick disc-shaped washer 31, the thickness of the washer being slightly greater than the thickness of ears 14.16 of the clip 10, and the washer outside diameter being slightly less than the width of slots 18, 20 so that washer 31 is slideably insertable within slots 18, 20. In assembly, thick disc-shaped washers 31 are inserted in elongated slots 18, 20 of ears 14, 16 and the threaded members 28 screwed into the curtain wall framing stud 32 securely fastening washers 31 to the curtain wall stud 32. Since the washers 31 are slightly thicker than the thickness of ears 14, 16 the head of threaded members 28 will be slightly spaced from the ears 14, 16 and thus the curtain wall clip 10 can slide up and down in secured relationship to the curtain wall stud 32. Advantageously, the offset relationship of the ears 14, 16 and elongated slots 18, 20 allow the clip 10 to be used even with webbed curtain wall framing studs having holes therein, as shown in FIG. 2, by providing attachment points outside the stud hole on opposite sides of the curtain wall stud face. Additionally, since the curtain wall clip 10 provides two fastening points on opposite sides of the curtain wall stud face, a much stronger attachment is provided than with prior art curtain wall clips which have only a single fastening point to a curtain wall stud. Moreover, the curtain wall clip of the present invention can be used with many different types of curtain wall studs such as C-shaped, channel-shaped or Z-shaped curtain wall studs, for example.

FIGS. 7–10 illustrate several preferred spacer means that can be employed with the curtain wall clip 10 or other curtain wall slide clips having an elongated slotted arrangement. Each spacer means has a flat supporting portion for supporting the head of a threaded member and a downwardly projecting portion extending essentially perpendicularly from the flat supporting portion a predetermined height. The predetermined height of the downwardly projecting portion is selected to be slightly greater than the thickness of the slotted ears of the curtain wall clip. The width of the downwardly projecting portion is selected to be slightly less than the width of the elongated slot of the curtain wall clip so it can slideably seat therein.

Figure 4:
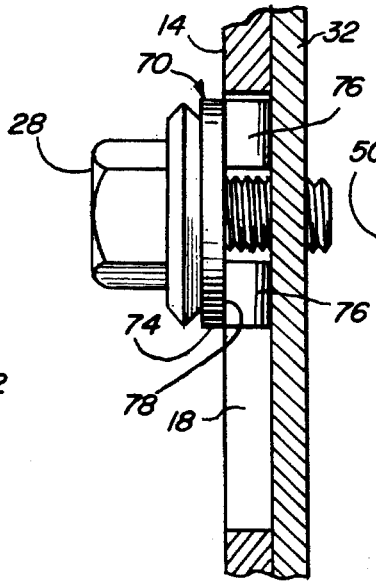
FIG. 4 is a sectional view of an alternative fastening arrangement for slideably securing the curtain wall clip to a curtain wall stud.
Figure 7:
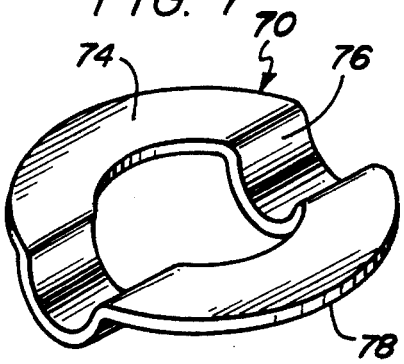
FIG. 7 is a perspective view of the spacer means employed in the fastening arrangement illustrated in FIG. 4.

More particularly, the spacer means 30 shown in FIG. 7 has two half ring-shaped portions 74 coupled by two U-shaped downwardly projecting portions 76, forming a dimpled washer 70. FIG. 4 illustrates the seating of dimpled washer 70 when bolted by threaded member 28 into an elongated slot 18 of a curtain wall clip. The U-shaped downwardly projecting portion 76 abuttingly seats against the front surface of curtain wall stud 32. The two half ring portions 74 form a flat supporting portion which extends over the ear and is spaced therefrom. The clearance is may be about 1/64th of an inch, for example. The curtain wall ears can therefore slide unrestricted under the flat supporting portion 73 of dimpled washer 70, while being secured to the curtain wall stud.

Figure 8:
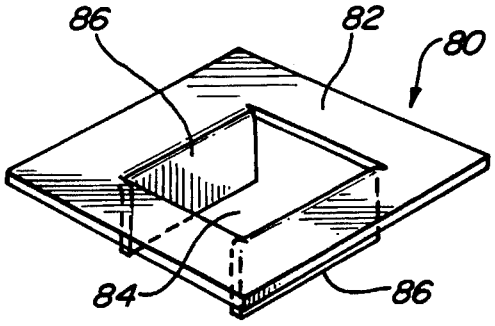
FIG. 8 is a perspective view of another embodiment of a spacer means.
Figure 11:
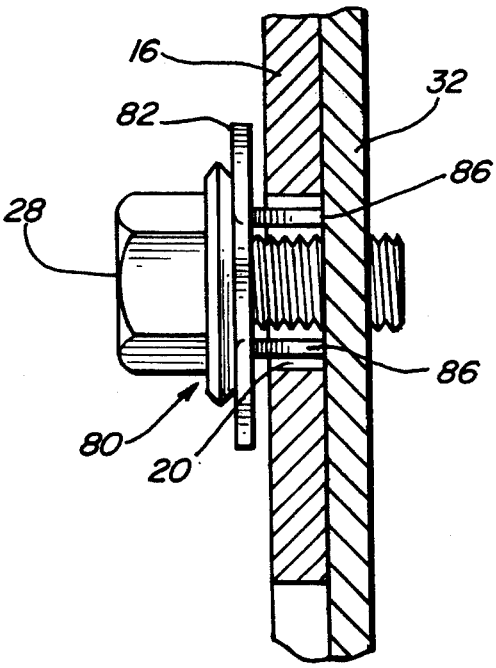
FIG. 11 is a transverse cross-sectional view of a curtain wall clip ear slideably fastened to a curtain wall stud using the spacer means illustrated in FIG. 8.

FIG. 8 illustrates a square washer 80 which comprises a flat rectangular shaped ring 82 with a rectangular shaped hole 84 therethrough. Two flaps 86 extend from oppositely disposed inner edges of the rectangularly shaped ring 82 in a perpendicular relationship to ring 82. The height of the flaps 86 is selected to be slightly greater than the thickness of the slotted ears and the separation distance between the flaps selected to be slightly less than the width of the elongated slot in curtain wall clip 10. FIG. 11 shows the particular spacer means illustrated in FIG. 8, namely square washer 80, fastened by threaded member 28 to curtain wall stud 32 in elongated slot 20 of ear 16. The ear of the curtain wall clip can slide under the rectangular shaped ring 82 along flaps 86 while being retained to the curtain wall stud by the flat rectangularly shaped ring 82.

Figure 9:
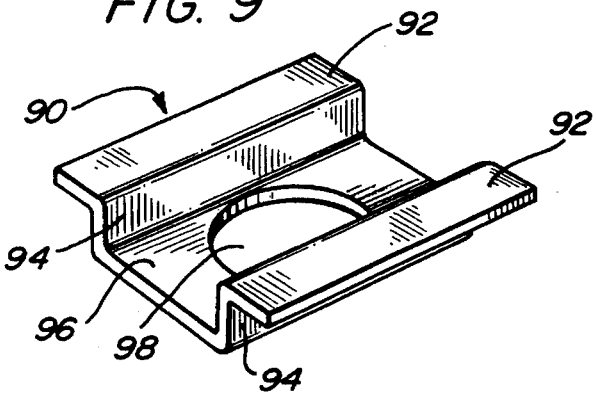
FIG. 9 is a perspective view of still another embodiment of a spacer means.

Another spacer means is illustrated in FIG. 9 having a U-shaped configuration comprising flat coplanar top walls 92 which in turn essentially perpendicularly downwardly into side walls 94 which terminate into bottom wall 96. A hole 98 is centrally disposed in bottom wall 98 of the U-shaped washer 90, which is sized to receive the threaded portion of a threaded member. The height of the side walls 92 are selected to be slightly greater than the thickness of the curtain wall ear it will be employed with and the side wall separation selected to be slideably insertable within the elongated slot.

Figure 10:
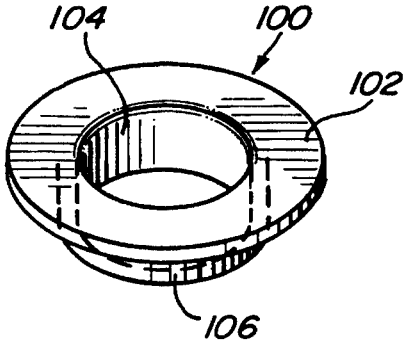
FIG. 10 is a perspective view of yet another embodiment of a spacer means.

The hat shaped washer 100 shown in FIG. 10 provides another simple, yet reliable spacer means which comprises a ring shaped supporting portion 102 having hole 104 with a downwardly disposed cylindrical portion 106. The cylindrical portion 106 is sized to be slideably insertable within an elongated slot and the height of the cylindrical portion 106 is selected to be slightly greater than the thickness of the intended slotted ear. The head of a threaded member employed to fasten this washer to a curtain wall stud will seat on the ring shaped supporting portion which is spaced slightly from the ear so it can slide thereunder.

While any of these aforedescribed spacer means may be employed with a slotted ear arrangement, the rectangular shaped washer 80 is the most preferred embodiment because it is simple and inexpensive to manufacture by well known thin gauge metal forming techniques.

Figure 5:
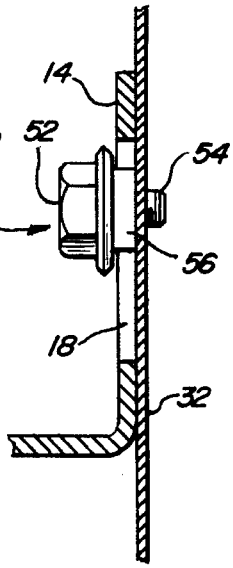
FIG. 5 is a sectional view of another fastening arrangement for slideably securing a curtain wall clip to a curtain wall stud.

A fastening means which provides a mechanism for slideably attaching the curtain wall clip 10 to a stud in a sliding arrangement can be realized with a threaded member as shown in FIG. 5. The fastening element 50 in FIG. 5 includes a head 52, a threaded portion 54 and a cylindrical shank portion 56 therebetween. The diameter of the cylindrical shank portion 56 is selected to be slightly smaller than the width of elongated slots 18, 20, and the length of the cylindrical shank portion 56 is selected to be slightly greater than the thickness of the ears 14, 16. In assembly, the shank portion 56 slideably seats in the elongated slots of the ears 14, 16 and tightens against the curtain wall stud 32, the head 52 holding curtain wall clip 10 in sliding engagement with the curtain wall stud.

Figure 6:
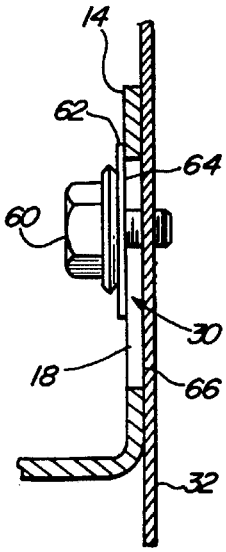
FIG. 6 is a sectional view of yet another fastening arrangement for slideably securing a curtain wall clip to a curtain wall stud.

Another embodiment providing a fastening means is illustrated in FIG. 6 wherein each ear 14, 16 of the curtain wall clip 10 are slideably secured to a curtain wall stud 32 using threaded member 60 and flat washer 62, serving as spacer means 30. The flat washer 62 may be made of nylon or perhaps metal having its inner engaging surface 64 coated with a slippery material, such as Teflon (™). In any case, the inner ear engaging surface 64 of the washer 62 has low friction surface properties. The engaging surface 66 of the ears 16, 18 may also be coated with a low friction material such as Teflon to provide a low friction surface in contact the curtain wall stud 32. The screw 60 is torqued such that the ears 14, 16 will be held in sliding engagement with curtain wall stud 32. The threaded portion of screw 60 is preferably affixed to the curtain wall stud 32 by a simple weld, or a screw with a self-locking thread may be employed.

In FIG. 7, various applications for the slide clip 10 to a building structure are illustrated, demonstrating its versatility in use. A floor structure 71 may include a cement slab having a circumscribing angle 72 and I-beam 73 disposed thereunder, for support and strength. The attachment portion, namely the flat plate portion 12 of the curtain wall clip of the present invention may be attached to the floor slab at various points, such as along the top edge of the circumscribing angle iron 72. A preferred attachment means may comprise welding, as well as power driven fasteners or expansion anchors. The ears of the curtain wall clip 10 of course may be slideably secured to the curtain wall stud 32 by any of the fastening means described above. Shown in phantom lines are other possible attachments locations for the curtain wall clip 10, such as at the bottom of the floor structure by attachment to the angle iron 72 bottom edge or the bottom of I-beam 73. Advantageously, the curtain wall clip 10 can be used where the floor structure 71 is separated from the curtain wall stud 26 by varying distances.

The above-described detailed description of a preferred embodiment described the best mode contemplated by the inventors for carrying out the present invention at the time this application was filed and is offered by way of example and not by way of limitation. Accordingly, various modification may be made to the above-described preferred embodiment without departing from the scope of the invention. Accordingly, it should be understood that although the invention has been described and shown for a particular embodiment, nevertheless various changes and modifications obvious to a person of ordinary skill in the art to which the invention pertains are deemed to lie within the spirit and scope of the invention as set forth in the following claims.

We claim:

1. A curtain wall connecting arrangement for coupling a curtain wall stud and building floor structure, comprising:

an elongated clip having two ends with an attachment portion at one end which is plate-like in shape and two oppositely, offset depending ears at the other end, each ear having an elongated slot therein disposed substantially perpendicular to the attachment portion; and spacer means and threaded members, said threaded members securing the spacer means and said two offset depending ears in slideable engagement with the curtain wall stud.

2. The curtain wall connecting arrangement defined in claim 1 wherein the spacer means comprises a flat supporting portion and a downwardly projecting portion extending essentially perpendicularly from the flat supporting portion a predetermined height for spacing the threaded member from the ear such that the ear can slide under the flat supporting portion.

3. The curtain wall connecting arrangement defined in claim 1 wherein the fastening means comprises two threaded members each having a head at one end, threaded shank portion at the other end and a cylindrical body therebetween, the threaded members slideably securing the ears to a curtain wall stud.

4. A clip assembly for securing a curtain wall framing structure to a floor structure, comprising:

a clip having two ends with an attachment portion at one end which is plate-like in shape and two oppositely depending offset ears at the other end each ear having elongated slots therein disposed substantially perpendicular to the attachment portion;

first fastening means comprising threaded screws having a threaded end, a head end, and a cylindrically shaped body portion therebetween, the body portion spacing the head from the clip ears for slideably securing said two ears to the curtain wall framing structure, and second fastening means for securely attaching the attachment portion of said clip to the floor structure.

5. The clip assembly defined in claim 4 wherein said first fastening means comprises threaded screws having a threaded end, a head end, and a cylindrically shaped body portion therebetween, the body portion spacing the head from the clip ears to allow the clip to slide freely.

6. The clip assembly defined in claim 4 wherein said clip has an elongated flat plate portion having two ends, the two ears located near one of said ends.

7. The clip assembly defined in claim 4 wherein said first fastening means comprises spacers means slideably seated within the slots and threaded means for securing said spacer means to the curtain wall member, the spacer means spacing the threaded means from the ears such that the ears can slide under the spacer means and threaded member.

8. In a curtain wall clip having an elongated slot therein, a fastening arrangement for slideably securing the curtain wall clip to a curtain wall stud, comprising:

a threaded member, and a spacer having a flat supporting portion and a downwardly projecting portion, said downwardly projecting portion seated within the elongated slot and the threaded member securing the spacer to the curtain wall stud such that the curtain wall clip can slide in a secured relationship under the spacer.

9. The fastening arrangement defined in claim 8 wherein the spacer comprises a rectangular ring shaped flat supporting portion and two oppositely disposed flaps within the rectangular ring projecting downwardly a predetermined height which is greater than the thickness of the curtain wall clip.

10. A wall connecting arrangement for coupling a wall stud and building floor structure, comprising:

an elongated clip having two ends with an attachment portion at one end and two oppositely, offset depending ears at the other end, each ear having an elongated slot therein;

a wall stud;

a floor structure;

first fastening means for securing said two offset depending ears in slideable engagement with the curtain wall stud, and second fastening means for securing said attachment portion to the floor structure.

11. The wall connecting arrangement defined in claim 10 wherein the fastening means comprises spacer means and threaded member, said threaded members securing the spacer means and two ears in slideable engagement with the curtain wall stud.

12. The wall connecting arrangement defined in claim 11 wherein the spacer means comprises a flat supporting portion and a downwardly projecting portion extending essentially perpendicularly from the flat supporting portion a predetermined height for spacing the threaded member from the ear such that the ear can slide under the flat supporting portion.

13. The wall connecting arrangement defined in claim 10 wherein the fastening means comprises two threaded members each having a head at one end, threaded shank portion at the other end and a cylindrical body therebetween, the threaded members slideably securing the ears to the wall stud.

14. The wall connecting arrangement defined in claim 10 wherein the second fastening means comprises welding.

15. A clip assembly for securing a curtain wall framing structure to a floor structure, comprising:

a clip having two ends with an attachment portion at one end which is plate-like in shape and two oppositely depending offset ears at the other end each ear having elongated slots therein disposed substantially perpendicular to the attachment portion;

first fastening means comprising spacer means slideably seated within the slots and threaded means for securing said spacer means to the curtain wall member, the spacer means spacing the threaded means from the ears such that the ears can slide under the spacer means and threaded member, and second fastening means for securely attaching the attachment portion of said clip to the floor structure.

16. The clip assembly defined in claim 15 wherein said spacer means is a thick disk shaped washer.

17. The clip assembly defined in claim 15 wherein said spacer means comprises a rectangularly shaped washer having a rectangular shaped ring and two flaps oppositely depending essentially perpendicularly therefrom.

18. The clip assembly defined in claim 15 wherein said second fastening means comprises welding.

19. The clip assembly defined in claim 15 wherein said spacer means comprises a hat shaped washer with a ring shaped supporting portion and downwardly disposed cylindrical portion slideably seated within the elongated slot.

20. The clip assembly defined in claim 15 wherein said spacer means comprises a U-shaped washer seated within the elongated slot for spacing the threaded member for the ears.

* * * * *